US005993478A

United States Patent [19]

Nowak

[11] Patent Number: 5,993,478

[45] Date of Patent: Nov. 30, 1999

[54] TEETHER

[75] Inventor: Ralph M. Nowak, Marblehead, Mass.

[73] Assignee: The First Years Inc., Mission Viejo, Calif.

[21] Appl. No.: 09/121,769

[22] Filed: Jul. 23, 1998

[51] Int. Cl.[6] ..... A61J 17/00

[52] U.S. Cl. ..... 606/235; 606/234; 606/236

[58] Field of Search ..... 606/234, 235, 606/236

[56] References Cited

U.S. PATENT DOCUMENTS 5,511,273 4/1996 Carroll ..... 606/235

5,776,223 6/1998 Johnson ..... 606/235

5,827,527 10/1998 Leonard ..... 606/235

FOREIGN PATENT DOCUMENTS 2191104 12/1987 United Kingdom ..... 606/235

*Primary Examiner*—Michael Buiz

*Assistant Examiner*—Lien Ngo

*Attorney, Agent, or Firm*—Fish & Richardson P.C.

[57] ABSTRACT

A teether includes a frame adapted for teething by a child, the frame including a base, a first side extending upwardly from a first end of the base, and a second side extending upwardly from a second end of the base, wherein the first and second sides are integrally connected to the base and are connected to each other remote from the base.

12 Claims, 5 Drawing Sheets

TEETHER

BACKGROUND OF THE INVENTION

The invention relates to a teether and a method of making the teether.

As children grow and develop teeth, they often like to chew on various objects. Teethers can be provided to the children to help ensure that they do not chew on items that might, for example, be swallowed or that might injure them.

SUMMARY OF THE INVENTION

In general, in one aspect, the invention features a teether including a frame adapted for teething by a child, the frame including a base, a first side extending upwardly from a first end of the base, and a second side extending upwardly from a second end of the base, wherein the first and second sides are integrally connected to the base and are connected to each other remote from the base.

Implementations of the invention may include one or more of the following features. Each of the first and second sides can include an elongated member closed upon itself and hingedly attached to the base. Each of the elongated members can include a boss, and the teether can further include a coupling adapted to receive the bosses and to couple the first side to the second side. The frame can further include a third side integrally connected to, and extending downwardly from, a third end of the base and a fourth side integrally connected to, and extending downwardly from, a fourth end of the base, wherein the third and fourth sides can be coupled remotely from the base, and wherein each of the third and fourth sides can include an elongated member closed upon itself and hingedly attached to the base. Each of the elongated members can include a boss, and the teether can further include couplings adapted to receive the bosses and to couple the first side to the second side and to couple the third side to the fourth side.

In general, in another aspect, the invention features a method of forming a teether, the method including forming a substantially planar frame as a single piece from a flexible material, the frame including a central member and a plurality of peripheral members disposed about a perimeter of the central member, folding the plurality of peripheral members such that portions of the peripheral members are in close proximity to each other, and coupling the peripheral members together.

Implementations of the invention may include one or more of the following features. Each of the peripheral members can be joined to the central member by a length of the flexible material that is more easily bent than the central member and the peripheral member to which the length of material is connected. Each length of the flexible material can be thinner than thicknesses of the central member and the peripheral member to which the length of material is connected. The frame can include four peripheral members, wherein two of the peripheral members can be folded upwardly from the base and coupled above the base, and wherein the other two peripheral members can be folded downwardly from the base and coupled below the base.

In general, in another aspect, the invention features a teether including an integral frame adapted for teething by a child, the frame including, a substantially planar base having a top surface and a bottom surface, a front loop connected to the base by a front hinge, a rear loop connected to the base by a rear hinge disposed opposite the front hinge, a left loop connected to the base by a left hinge, a right loop connected to the base by a right hinge disposed opposite the left hinge, a first casing coupling portions of the front and rear loops above the top surface of the base, and a second casing coupling portions of the left and right loops below the bottom surface of the base.

Implementations of the invention may include one or more of the following features. The loops can each include bosses extending outwardly from a length of the loop, and wherein the first and second casings can define openings for receiving the bosses.

Embodiments of the invention may provide one or more of the following advantages. Multiple teething surfaces can be provided to a child. A teether can be easily grasped by a child. A complex-shaped teether can be manufactured in an easy and inexpensive manner.

Other advantages will become apparent from the following description and from the claims.

DESCRIPTION OF PREFERRED EMBODIMENTS

Figure 1:
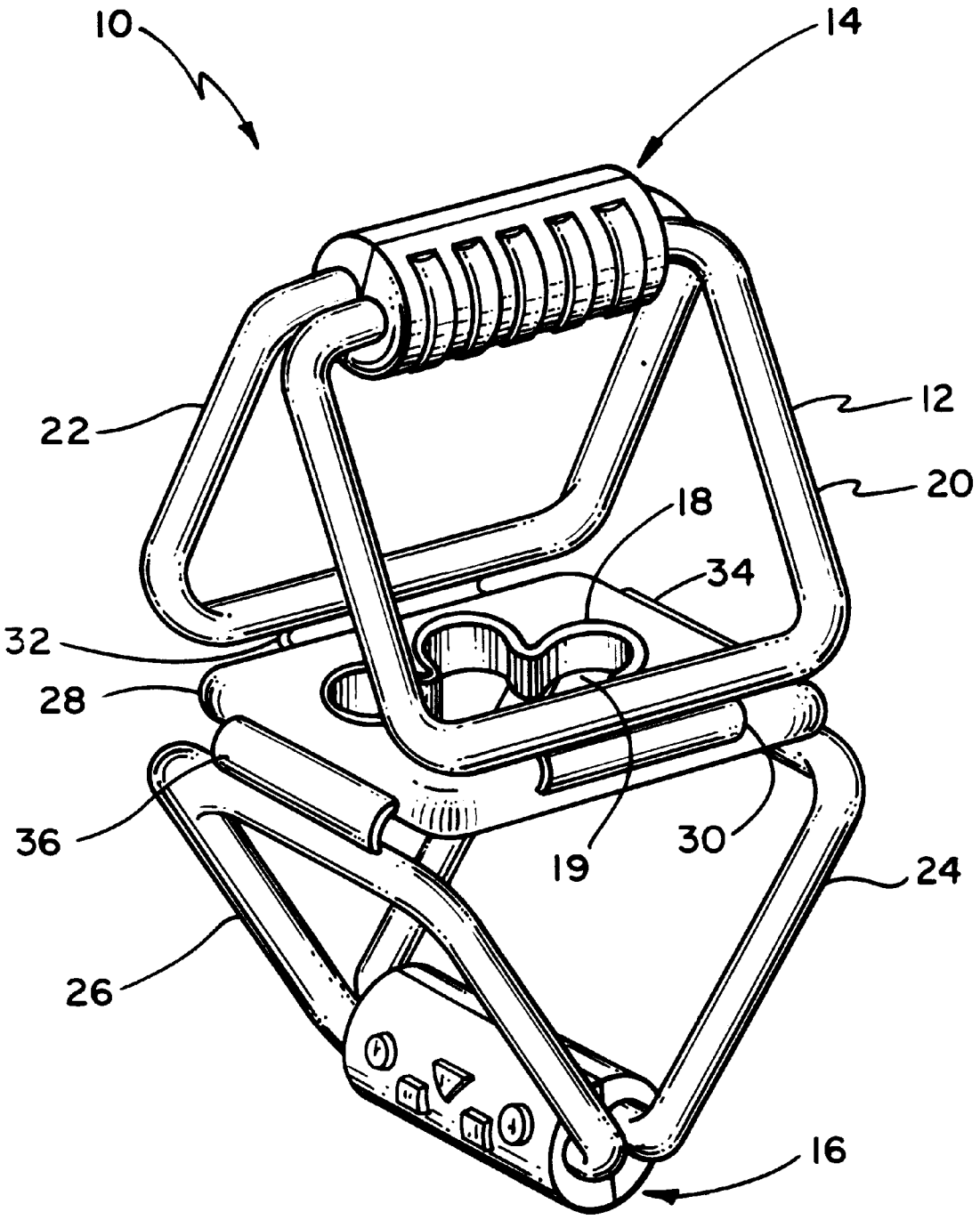
FIG. 1 is a perspective view of an assembled teether.
Figure 2:
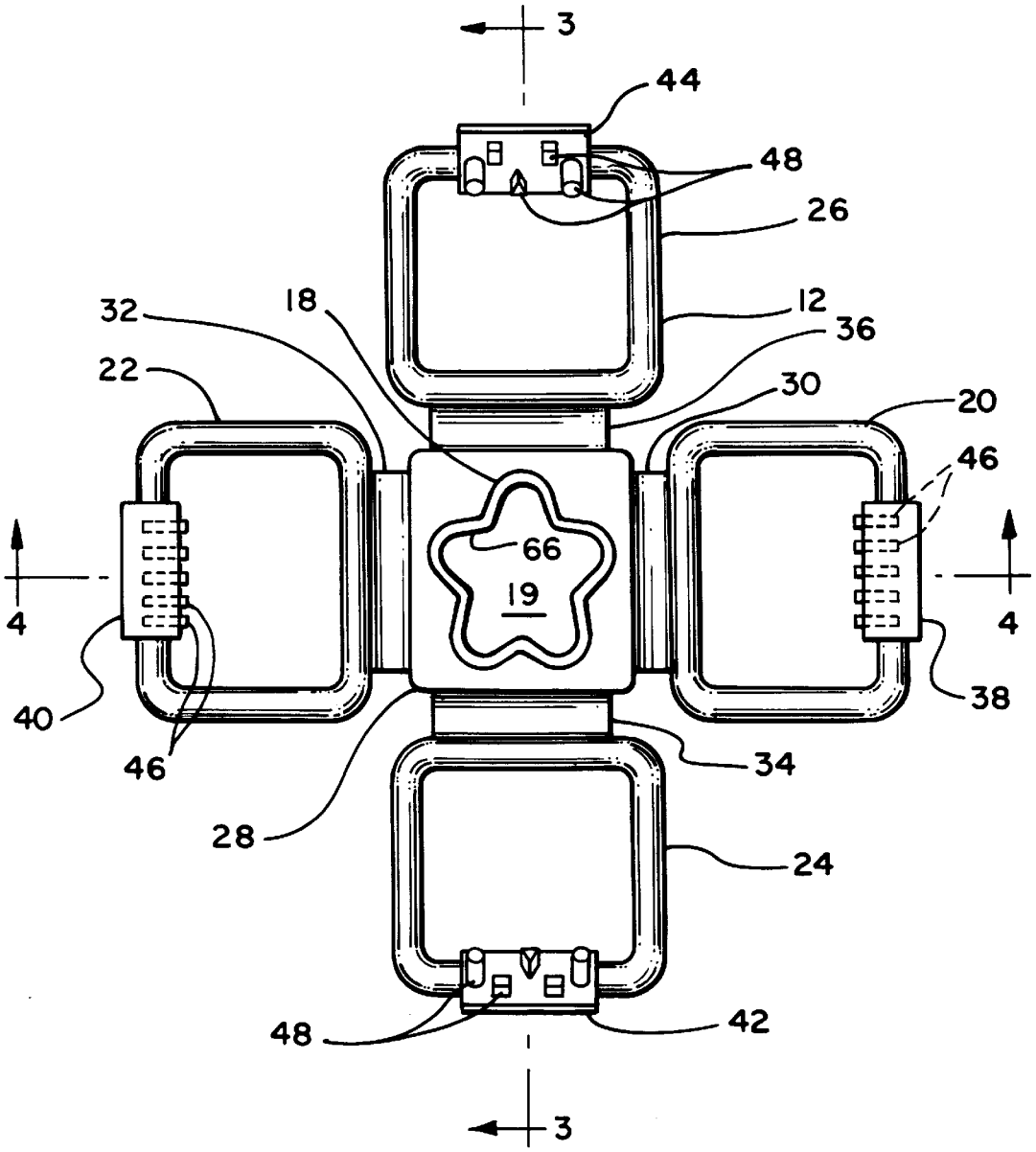
FIG. 2 is a top plan view of a frame and a centerpiece of the teether shown in FIG. 1.

As shown in FIGS. 1 and 2, a teether 10 includes a frame 12, two casings 14 and 16, and a centerpiece 18 molded within a base 28 of frame 12, with a circumferential rim 66 defining an aperture 19. Frame 12 is made of flexible yet durable material, e.g. polyvinyl-chloride (PVC), that is suitable for teething by a child. Casings 14 and 16 and centerpiece 18 are made of a durable material, e.g., acrylonitrile-butadiene-styrene (ABS). Casings 14 and 16 and centerpiece 18 can be of different colors from frame 12. As shown, casings 14 and 16 receive and couple portions of frame 12.

Referring to FIG. 2, frame 12 and centerpiece 18 are substantially planar without casings 14 and 16. Frame 12 includes four loops or rings 20, 22, 24, and 26, and a base 28 connected to loops 20, 22, 24, and 26 by hinges 30, 32, 34, and 36, respectively. Loops 20, 22, 24, and 26 have generally rectangular perimeters formed by cylindrical elongated members, or shafts, that are closed upon themselves. Other perimeter shapes such as circles, and other shapes of shafts such as squares, are possible and within the scope of the invention. Loops 20, 24, 26, and 28 include plates 38, 40, 42, and 44, respectively. Plates 38 and 40 include protrusions 46 and plates 42 and 44 include protrusions 48. Protrusions 46 are substantially rectangular ribs and protrusions 48 have circular, triangular and square shapes. Other shapes of protrusions 46 and 48 are possible and within the scope of the invention.

Figure 3:
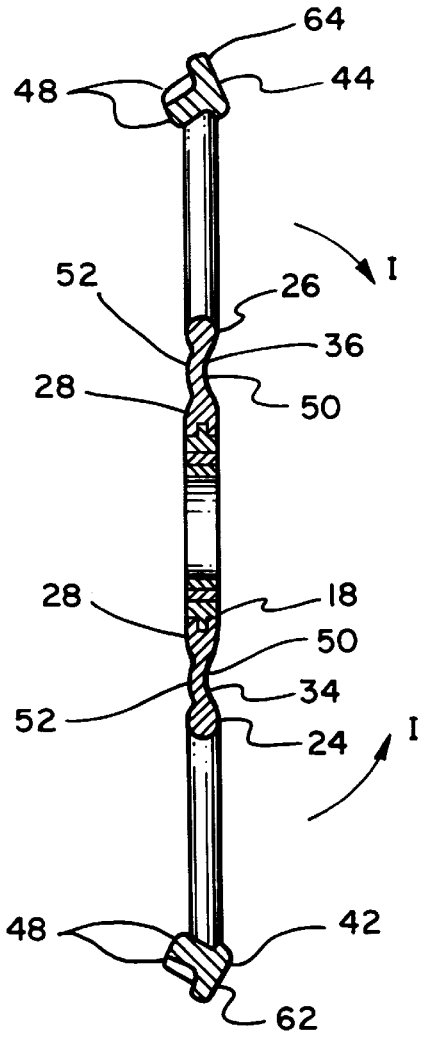
FIG. 3 is a cross-sectional view taken along line 3—3 shown in FIG. 2.
Figure 4:
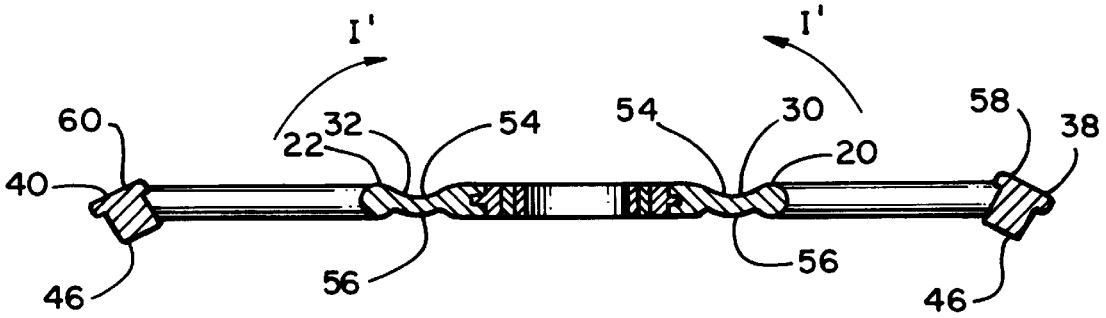
FIG. 4 is a cross-sectional view taken along line 4—4 shown in FIG. 2.

As shown in FIGS. 3 and 4, hinges 30, 32, 34, and 36 have arcuate cross sections and plates 38, 40, 42, and 44 are tilted so that protrusions 46 and 48 are directed outwardly. Hinges 34 and 36 are thinner than the thicknesses of base 28 and loops 24 and 26, and are curved so that they have concave bottom surfaces 50 and convex top surfaces 52. Hinges 30 and 32 are thinner than base 28 and loops 20 and 22, and are curved to have concave top surfaces 54 and convex bottom surfaces 56. The arcuate shapes of hinges 30, 32, 34, and 36 facilitate folding loops 20 and 22 inward (arrows I) and folding loops 24 and 26 inward (arrows I'), and inhibit folding loops 20 and 22 and loops 24 and 26 in the opposite direction, i.e., outward. Plates 38, 40, 42, and 44 have mating surfaces 58, 60, 62, and 64, respectively. Plates 42 and 44 are tilted so that protrusions 48 extend outward from plates 42 and 44 and plates 38 and 40 are tilted so that protrusions 46 extend outward from plates 38 and 40.

Figure 5:
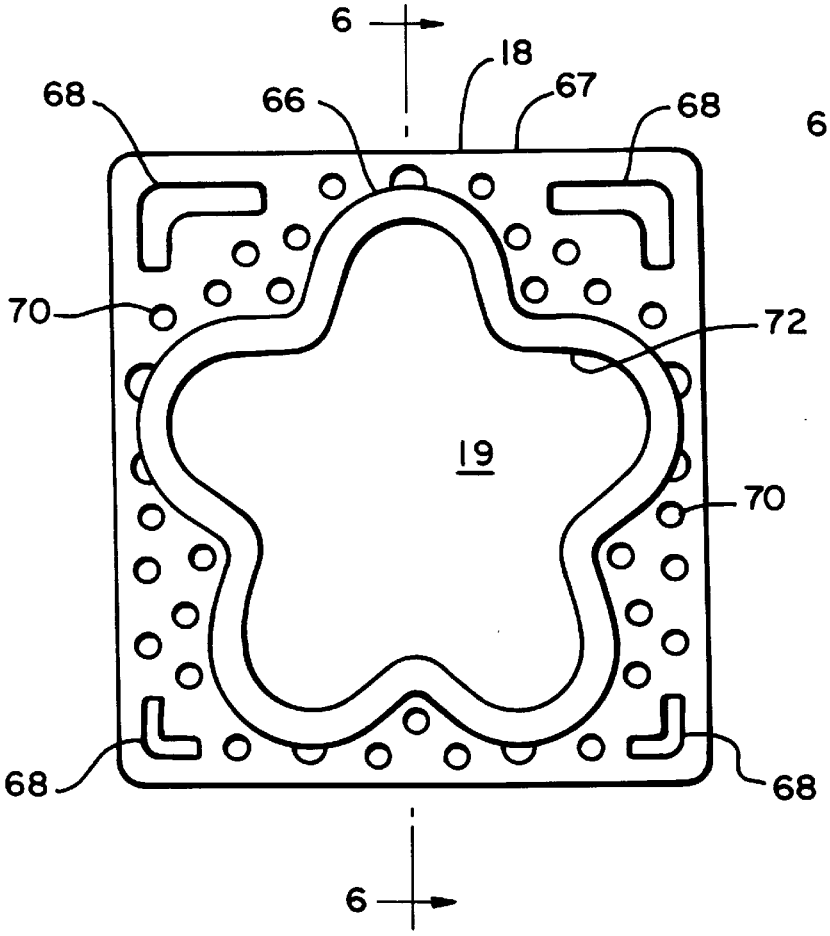
FIG. 5 is a top plan view of the centerpiece shown in FIG. 2.
Figure 6:
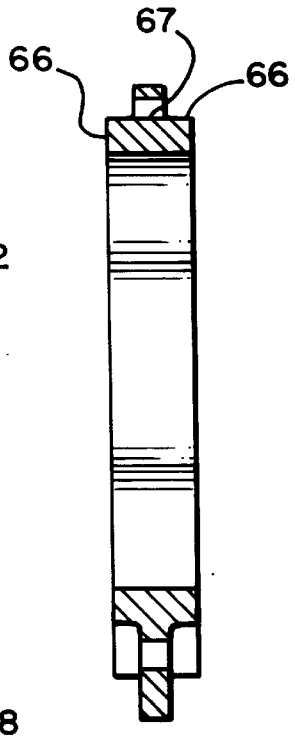
FIG. 6 is a cross-sectional view taken along line 6—6 shown in FIG. 5.

As shown in FIGS. 5 and 6, centerpiece 18 includes ridge 66, a body 67, and four slots 68 and multiple holes 70 through body 67. Body 67 is substantially square and is adapted to be encapsulated by base 28. Body 67 has a smaller thickness than ridge 66, which extends in both directions from a plane of body 67. Centerpiece 18 has a surface 72 defining a central opening 19 bordered by ridge 66 and body 67.

Figure 7:
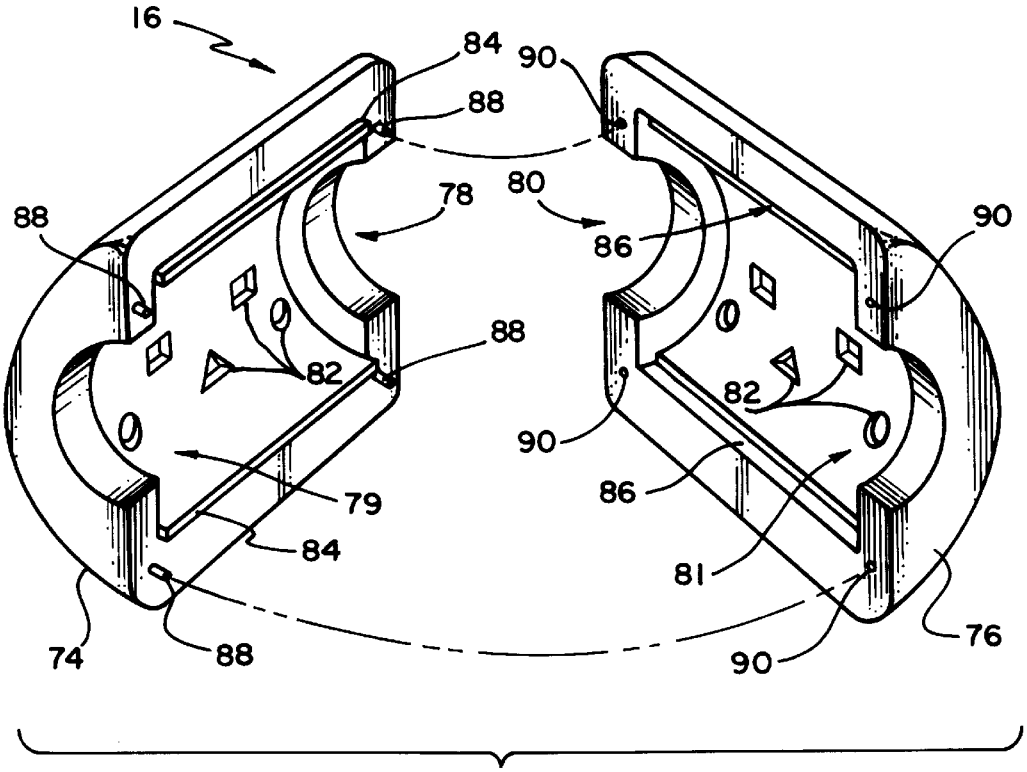
FIG. 7 is an exploded schematic view of a casing shown in FIG. 1.

As shown in FIG. 7, casing 16 includes a male half 74 and a female half 76 adapted to receive portions of loops 24 and 26. Each half 74, 76 is cylindrically shaped with half-cylindrical regions 78, 79, 80 and 81 adapted to receive plates 42 and 44 and half the circumference of the shafts of frame 12. Each half 74, 76 also includes several holes 82 adapted to receive protrusions 48. Shelves 84 of male half 74 are received by recesses 86 of female half 76. Pins 88 of male half 74 are received by holes 90 of female half 76. Similar casing halves make up casing 14, with holes 82 adapted to receive protrusions 46.

Teether 10 is assembled as follows. Centerpiece 18 is molded as shown in FIGS. 5 and 6. Frame 12 is molded over centerpiece 18 as shown in FIG. 2, with frame material flowing through slots 68 and holes 70, but not central opening 19, enclosing body 67 of centerpiece 18 in frame 12. Loops 24 and 26 are folded or bent inward until mating surfaces 62 and 64 of plates 42 and 44 touch. Pins 88 of male casing half 74 of casing 16 are dipped in glue and inserted into mating holes 90 in female casing half 76 around plates 42 and 44 such that holes 82 receive protrusions 48. Protrusions 48 extend through holes 82 outside of casing 16 about 1 mm. Halves 74 and 76 of casing 16 are sonic welded together. Loops 20 and 22 are folded or bent inward until mating surfaces 58 and 60 of plates 38 and 40 touch. Pins of the male casing half of casing 14 are dipped in glue and inserted into mating holes in the female casing half of casing 14 around plates 38 and 40 such that holes in casing 14 receive protrusions 46. Protrusions 46 extend through holes 82 outside of casing 16 about 1 mm. The two halves of casing 14 are sonic welded together.

In use, a child can grasp and chew on teether 10. The child can grasp, e.g., the shafts of frame 12. The child can chew on any part of frame 12, including the ends of protrusions 46 and 48 extending through holes in casings 14 and 16. Thus, protrusions 46 and 48 provide teething surfaces at their ends.

Other embodiments are within the scope of the invention.

What is claimed is:

1. A teether comprising:

a frame adapted for teething by a child, the frame including:

a base;

a first side member extending upwardly from a first end of the base; and a second side member extending upwardly from a second end of the base;

wherein the first and second side members are integrally and hingedly connected to the base and are connected to each other remote from the base.

2. The teether of claim 1 wherein each of the first and second members comprises an elongated member closed upon itself.

3. A teether comprising:

a frame adapted for teething by a child, the frame including:

a base;

a first side member extending upwardly from a first end of the base;

a second side member extending upwardly from a second end of the base; and a coupling;

wherein the first and second side members are integrally connected to the base and are connected to each other remote from the base;

wherein each of the first and second side members comprises an elongated member closed upon itself and hingedly attached to the base, and each of the elongated members includes a boss; and wherein the coupling is adapted to receive the bosses and to couple the first side to the second side.

4. The teether of claim 1 wherein the frame further comprises a third side member integrally connected to, and extending downwardly from, a third end of the base and a fourth side member integrally connected to, and extending downwardly from, a fourth end of the base, wherein the third and fourth side members are coupled remotely from the base, and wherein each of the third and fourth side members comprises an elongated member closed upon itself and hingedly attached to the base.

5. A teether comprising:

a frame adapted for teething by a child, the frame including:

a base;

a first side member extending upwardly from a first end of the base;

a second side member extending upwardly from a second end of the base;

a third side member extending downwardly from a third end of the base; and a fourth side member extending downwardly from a fourth end of the base; and couplings;

wherein the first and second side members are integrally connected to the base and are connected to each other remote from the base;

wherein the third and fourth side members are integrally connected to the base and are connected to each other remote from the base;

wherein each of the third and fourth side members comprises an elongated member closed upon itself and hingedly attached to the base;

wherein each of the elongated members includes a boss; and wherein the couplings are adapted to receive the bosses and to couple the first side member to the second side member and to couple the third side member to the fourth side member.

6. A method of forming a teether, the method comprising:

forming a substantially planar frame as a single piece from a flexible material, the frame including a central member and a plurality of peripheral members disposed about a perimeter of the central member;

folding the plurality of peripheral members such that portions of the peripheral members are in close proximity to each other; and coupling the peripheral members together.

7. The method of claim 6 wherein each of the peripheral members are joined to the central member by a length of the flexible material that is more easily bent than the central member and the peripheral member to which the length of material is connected.

8. The method of claim 7 wherein each length of the flexible material is thinner than thicknesses of the central member and the peripheral member to which the length of material is connected.

9. The method of claim 6 wherein the frame includes four peripheral members, wherein two of the peripheral members are folded upwardly from the base and coupled above the base, and wherein the other two peripheral members are folded downwardly from the base and coupled below the base.

10. A teether comprising:

an integral frame adapted for teething by a child, the frame including:

a substantially planar base having a top surface and a bottom surface;

a front loop connected to the base by a front hinge;

a rear loop connected to the base by a rear hinge disposed opposite the front hinge;

a left loop connected to the base by a left hinge;

a right loop connected to the base by a right hinge disposed opposite the left hinge;

a first casing coupling portions of the front and rear loops above the top surface of the base; and a second casing coupling portions of the left and right loops below the bottom surface of the base.

11. The teether of claim 10 wherein the loops each comprise bosses extending outwardly from a length of the loop, and wherein the first and second casings define openings for receiving the bosses.

12. The teether of claim 1 wherein the first and second side members extend from the base to separate respective connection portions that are connected in close proximity to each other remote from the base.

* * * * *